US006444933B1

(12) United States Patent
Chun

(10) Patent No.: US 6,444,933 B1
(45) Date of Patent: Sep. 3, 2002

(54) KEY SWITCH

(75) Inventor: Gyu Chul Chun, Iksan (KR)

(73) Assignee: SMK Korea Co., Ltd., Iksan (KR)

( * ) Notice: Subject to any disclaimer, the term of this patent is extended or adjusted under 35 U.S.C. 154(b) by 0 days.

(21) Appl. No.: 09/949,124

(22) Filed: Sep. 7, 2001

(30) Foreign Application Priority Data

Jan. 23, 2001 (JP) ..... 2001-014245

(51) Int. Cl.[7] ..... H01H 13/70
(52) U.S. Cl. ..... 200/344
(58) Field of Search ..... 200/5 A, 512, 200/517, 344, 345

(56) References Cited

U.S. PATENT DOCUMENTS 5,488,210 A * 1/1996 Shigetaka et al. ..... 200/344
5,562,203 A * 10/1996 Mochizuki ..... 200/345
6,118,092 A * 9/2000 Hayashi ..... 200/344
6,297,461 B1 * 10/2001 Kamishima ..... 200/5 A

* cited by examiner

*Primary Examiner*—Michael Friedhofer
(74) *Attorney, Agent, or Firm*—Greenlee, Winner and Sullivan, P.C.

(57) ABSTRACT

Disclosed is a key switch comprising a key top for receiving pressure from a user's finger, a link for lowering the key top when pressure is applied to the key top and pushing the key top upwardly when the pressure is released, and a flexible printed circuit (FPC) provided on an upper surface of a keyboard frame for recognizing the key action by a pressing-contact of the link therewith. The link has first and second legs pivot-coupled with each other, a return plate spring applying a returning force to the key top, and a contact plate spring coming into pressing-contact with the FPC. The key switch has a simple structure and imparts a sufficient clicking sensation.

14 Claims, 10 Drawing Sheets

KEY SWITCH

CROSS-REFERENCE TO RELATED APPLICATIONS

This application takes priority from Japanese Patent Application No. 2001-014245 filed Jan. 23, 2001.

BACKGROUND OF THE INVENTION

1. Field of the Invention

The present invention relates to a key switch for a keyboard used as an input device in a personal computer and so on, and more particularly to such a key switch which can promote miniaturization and thinner-shaping of the keyboard, realize a large key stroke, and secure a key input and key operating feeling by imparting a clicking sensation at the time of key operation. Particularly, this key switch has a simple overall construction and thus enables assembly processes thereof to be easily and simply performed.

2. Description of the Prior Art

While a key has been more and more thinly formed in accordance with a tendency of thinner-shaping of keyboards in recent years, a large key stroke and clear key operating feeling with respect to key operation are required so as to enhance operability of a key input and to secure certainty of the key input. Various key switches have been proposed to be used for this kind of keyboard.

For example, Japanese Patent Laid-open No. Hei 8-279316 proposed the following key switch.

In the proposed key switch, means for guiding the vertical movement of a key top is constituted by a first link member and a second link member joined with each other in a form of a character "X" to guide the vertical movement of the key top. The first link member is formed with a spring member having a switch operating part at its end, and a supporting plate is formed with an inclined projection part having an inclined surface. When the key top is pushed down, pressure load of the key top is increased as the spring member is slid along the inclined surface of the inclined projection part. If the spring member is slid beyond the inclined projection part and then falls onto a switch sheet surface, the pressure load of the key top is suddenly lowered to impart a clicking sensation to a user. Simultaneously, the switch operating part of the spring member comes into pressing-contact with a switching section to achieve a switching-on key action.

This key switch can realize miniaturization and thinner-shaping of the keyboard by using the guiding member of the link structure instead of using a rubber spring. The key switch also imparts the clicking sensation by forming the inclined projection part in the supporting plate and sliding the switch operating part of the spring member beyond the inclined projection part to change the pressure load of the key top.

Since this conventional guiding member of the link structure is constituted by the first and second link members and is manufactured by assembling these link members, however, there is a drawback in that a number of processes are required for the assembly of the link members, thus increasing a manufacturing cost of the key switch.

The manufacturing cost is further raised because mechanical working of the supporting plate, such as forming the inclined projection part in the supporting plate, is needed to obtain the clicking sensation.

Also, the key top descends and collides directly with the frame without means of shock absorption, with the result that there is another problem of causing a noise.

Moreover, a pivot coupling is used for joining a keyboard frame and the links with each other, and the projection (pivot axis) of the pivot coupling is directly contacted with the frame, thereby causing still another problem in that the projection made of soft material is apt to be worn away by friction with the frame made of aluminum, etc. and so the life span of the overall key switch is shortened.

Furthermore, since a FPC (Flexible Printed Circuit) lying on the frame is not fixed, but may be moved to deviate a contact of the FPC from a point to which the pressure of the key top is applied, there is still another problem in that the key top does not exactly press the contact of the FPC even when it is pushed down, which results in a failure of the key input operation.

On the other hand, a multiple key switch for use in special keys such as a "space" key, an "enter" key and the like is so long that the pressure from the key top is not transmitted uniformly to the links and the key top gets crooked during the operation, thereby making it difficult to obtain a reliable contact force. In order to solve this problem, a link bar, etc. is used to transmit the pressure uniformly, but this requires additional assembly processes and so increases manufacturing costs.

SUMMARY OF THE INVENTION

Accordingly, the present invention has been made to overcome the above-mentioned problems, and it is an object of the present invention to provide a downsized, thin and inexpensive key switch by forming a guiding member having a simple link structure.

It is another object of the present invention to provide a key switch, which imparts a clicking sensation using a simple structure.

It is still another object of the present invention to provide a key switch, which generates less noise and realizes precise key switch actions.

It is further still another object of the present invention to provide a key switch, which transmits pressure uniformly when used as a multiple key switch.

To accomplish this object, there is provided a key switch in accordance with the present invention, the key switch comprising: a key top for receiving pressure from a user's finger; a link for lowering the key top when pressure is applied to the key top and pushing the key top upwardly when the pressure is released; and a flexible printed circuit (FPC) provided on an upper surface of a keyboard frame for recognizing the key action by a pressing-contact of the link therewith, wherein the link has a first and a second legs being pivot-coupled with each other, a return plate spring applying a returning force to the key top, and a contact plate spring coming into pressing-contact with the FPC, the first leg being also pivot-coupled with the frame and the second leg being also freely pivot-coupled with the frame through an slot-shaped hole, so that the second leg and the frame are slid relative to each other along the slot-shaped hole and stops the relative sliding movement at an end of the slot-shaped hole when the key top is pushed down against a resilient force of the return plate spring, and if the pressure load of the key top is further increased, the return plate spring takes a nearly rectilinear shape to abruptly reduce the pressure load, thereby imparting a clicking sensation.

Preferably, a contact projection is formed on a lower surface of the contact plate spring.

It is preferred that two return plate springs are formed while the contact plate spring being formed between the return plate springs, but the return plate spring is one in number and the contact plate spring is one in number.

Preferably, the first leg, the second leg, the return plate spring and the contact plate spring are integrally formed to constitute the link, the return plate spring may be separately formed of resilient metallic material such as steel, etc. and then is assembled to or insert-molded into the link, which is desirable in view of securing durability.

The first leg is simply and easily attached to and detached from the frame if resilience having a tendency to be outwardly bent.

The link can be simply manufactured at a low cost if it is formed by a mold.

It is also preferred that a pair of upright holes are formed in the frame, projections formed at both ends of the second leg are inserted into the upright holes, and the FPC is located between the projections and the frame. At least one of the upright holes is preferably located in an upper end portion of the frame and is opened upwardly.

Preferably, a projection is formed on a lower surface of the key top and the contact plate spring is formed in a nearly stair-like shape so that the pressure of the key top is absorbed by the contact plate spring after the return plate spring takes a nearly rectilinear shape.

The contact plate spring is preferably provided parallel to wings of the link so as to form the wing portions of the link with large thickness.

It is also preferred that the link is wholly received within a recess of the frame to reduce the overall height of the key switch.

BRIEF DESCRIPTION OF THE DRAWINGS

The above and other objects, features and other advantages of the present invention will be more apparent from the following detailed description taken in conjunction with the accompanying drawings, in which.

DETAILED DESCRIPTION OF THE PREFERRED EMBODIMENTS

Figure 1:
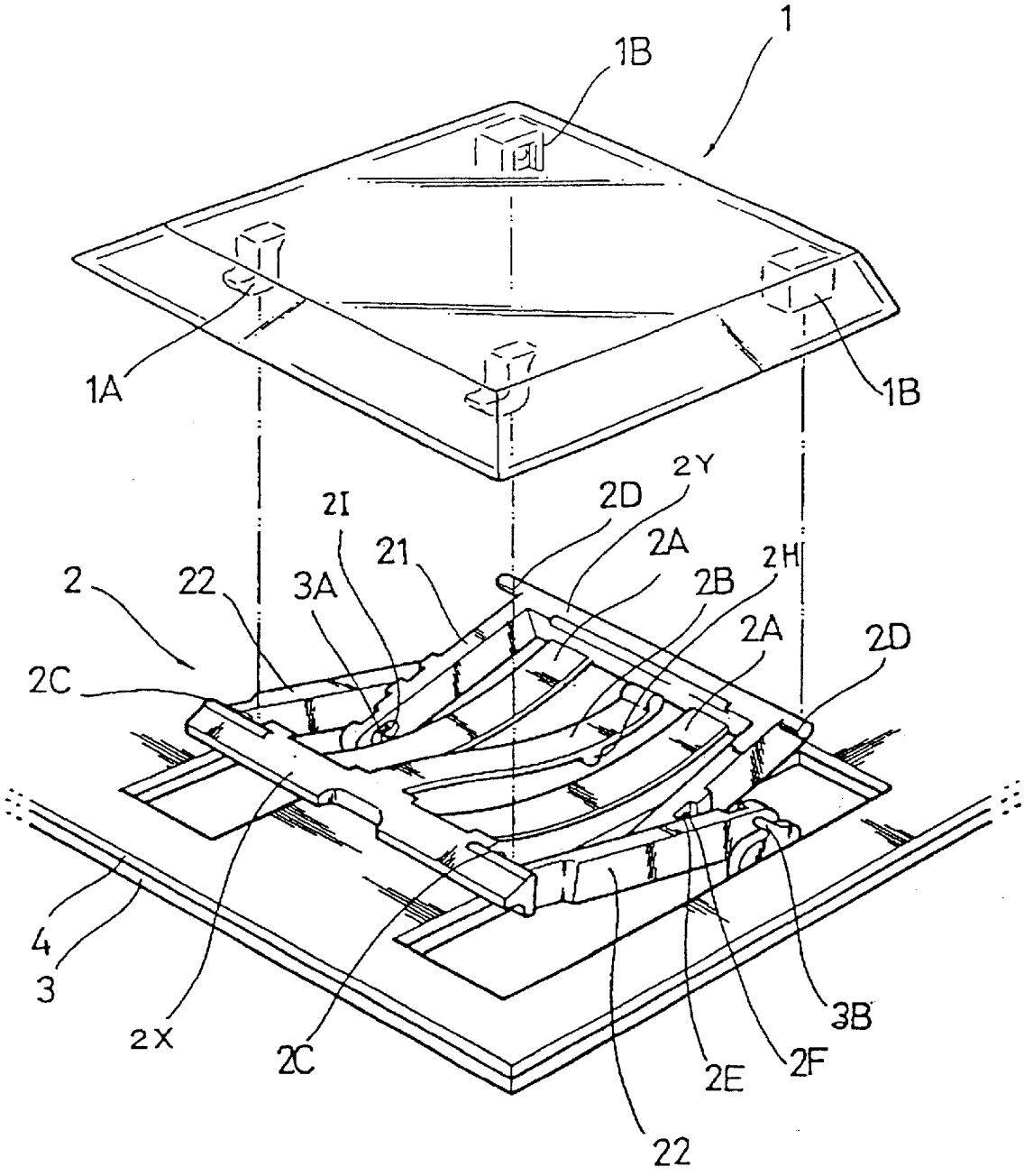
FIG. 1 is a perspective view of a key switch in accordance with the present invention.

Hereinafter, preferred embodiments of the present invention will be described with reference to accompanying drawings. In the following description and all drawings, the same reference numerals are used to designate the same or similar components, and so repetition of the description of the same or similar components will be omitted.

EXAMPLE 1

Figure 2A:
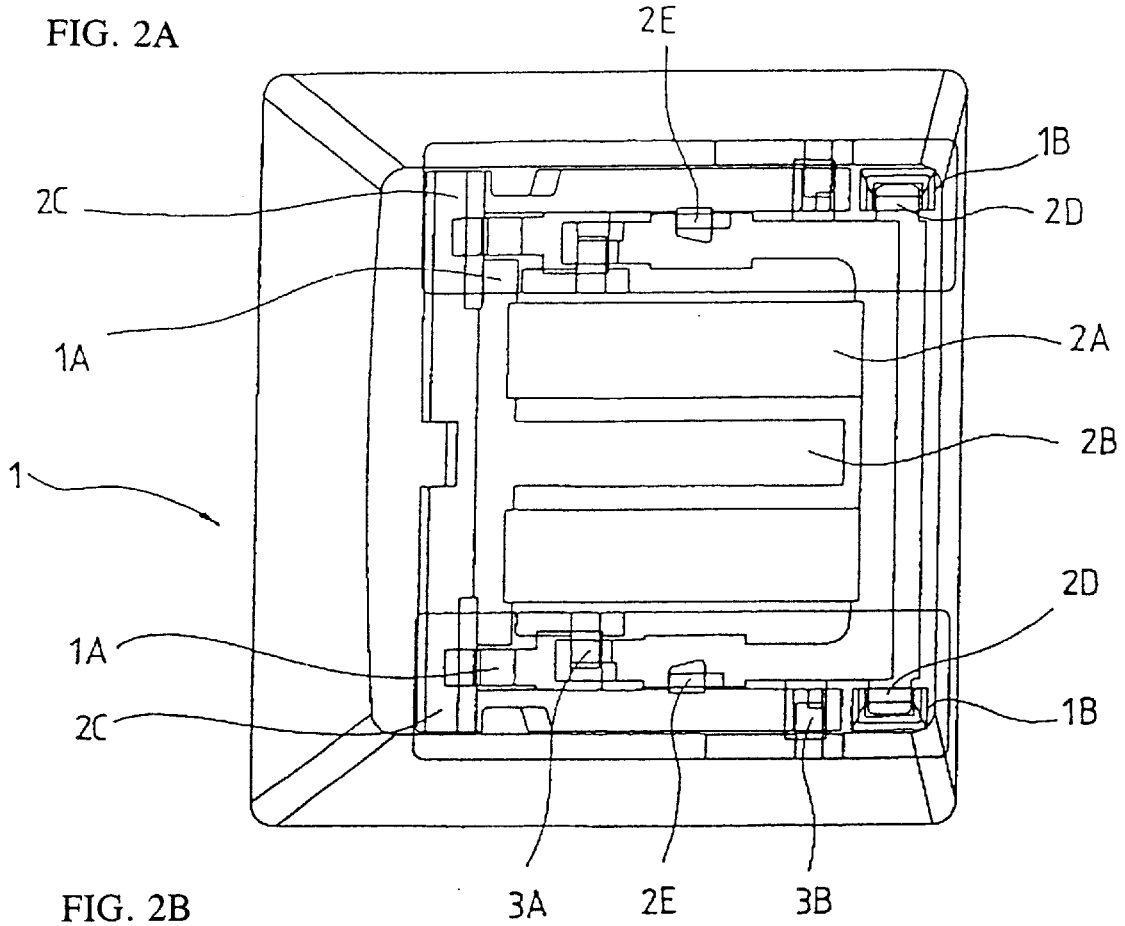
FIGS. 2A, 2B and 2C are respectively a plan view, a side view and a partially cutaway side view showing the key switch in an unpressed state.
Figure 2B:
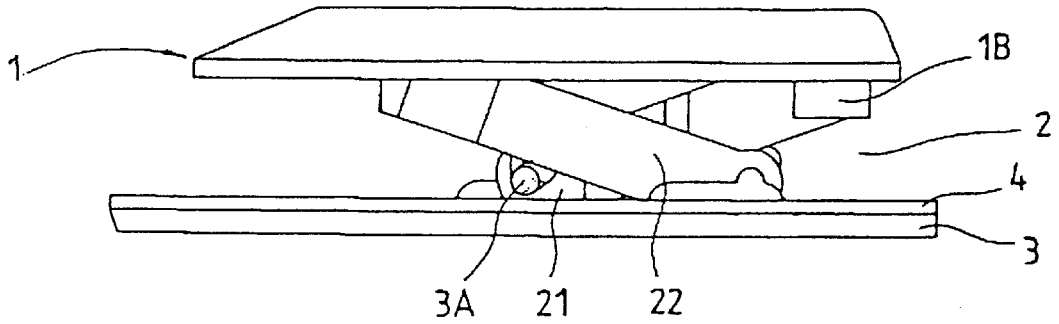
Figure 2C:
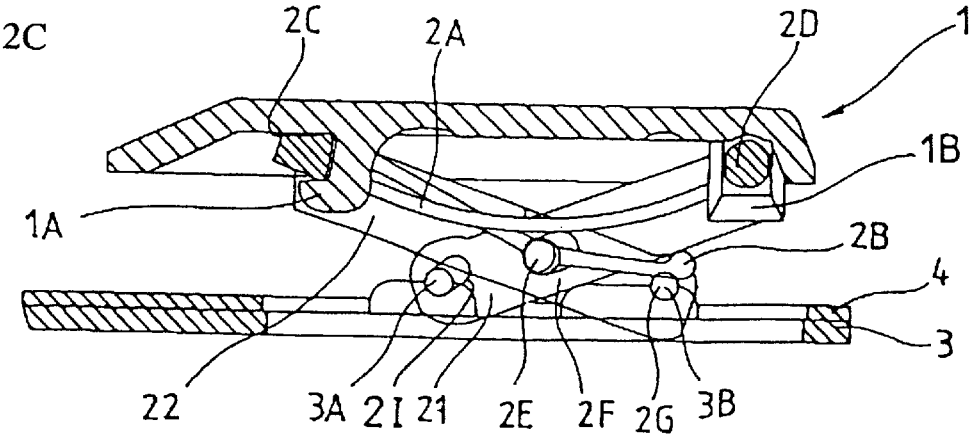

FIG. 1 is a perspective view of a key switch in accordance with the present invention, and FIG. 2 is a view showing the key switch whose key top is in the initial unpressed state of being not subjected to pressure from a user. Also, FIG. 3 is a view showing the key switch whose key top is pressed by a user's finger to its lowest position.

Figure 3A:
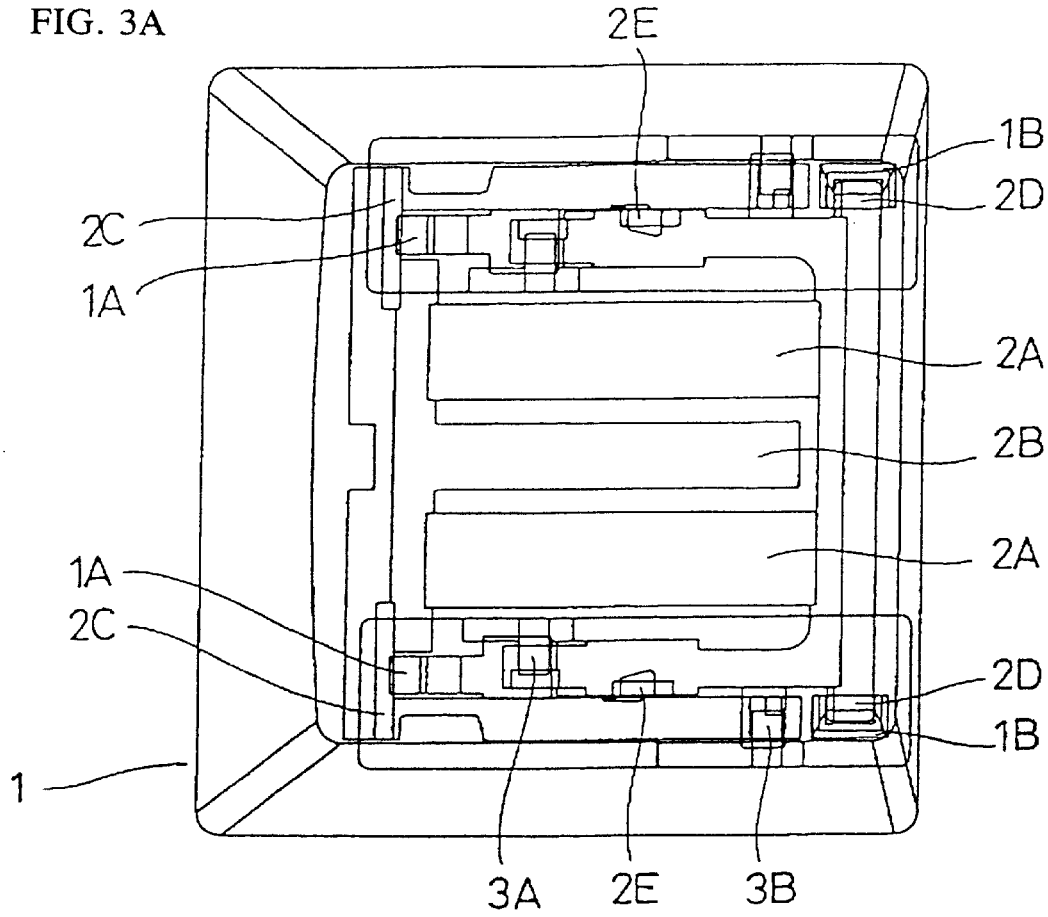
FIGS. 3A, 3B and 3C are respectively a plan view, a side view and a partially cut-out side view showing the key switch in a pressed and depressed state.
Figure 3B:
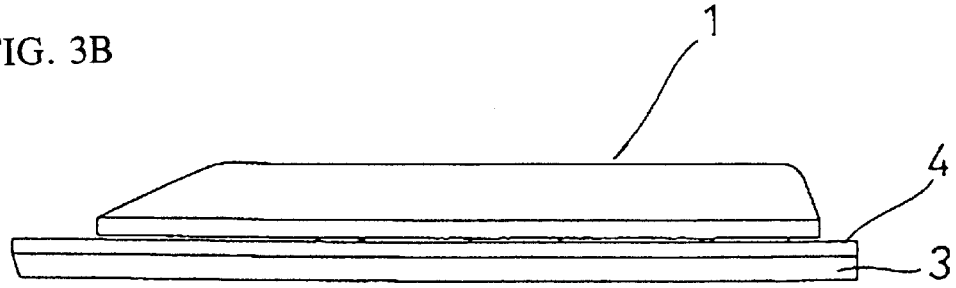
Figure 3C:
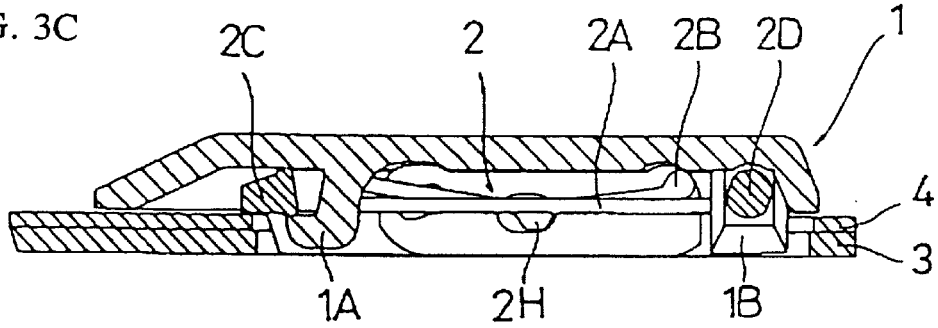

As seen from FIGS. 1 to 3, the key switch of the present invention is generally constituted by a key top 1, a link 2, a frame 3 and a FPC 4, which are arranged in order of the key top 1, the link 2, the FPC 4 and the frame 3 from the top to the bottom of the drawings, that is, from a top surface of a keyboard to a bottom thereof.

The key top 1 is located on the top surface of the keyboard, etc., and a numeral (0, 1, 2, 3, . . . ), a character (a, b, c, d, . . . , ㄱ, ㄴ, ㄷ, . . . , ㅏ, ㅑ, . . . , !, @, . . . ) or other function abbreviation (Esc, Ctrl, Alt, PgUp, . . . ) is printed on an upper surface of the key top. The key top is vertically moved in such a manner that it is pressed and moved downwardly by pressure applied from a user's finger to perform a key input, and returns to its initial state by pressure applied from the link as described below. The key top is a substantially rectangular roof-shaped member, and generally formed of plastic or the like.

The link 2 is a member for guiding the vertical movement of the key top 1, is subjected to the pressure of the key top to be depressed, and provides a clicking sensation when the return plate spring takes a nearly rectilinear shape.

The FPC (Flexible Printed Circuit) 4 is a circuit whose contacts are short-circuited by descent of the key top to recognize the character or the like corresponding to each key top, and is usually formed as a matrix circuit.

The frame 3 is provided with a mechanism for joining the frame 2 with the link 2, and supports the link 2 and thus the key top 1.

A description will be given for the respective members of the link and joining mechanisms connecting the respective members below.

A rear surface of the key top 1 is formed with a pair of link-fixing hooks 1A and a pair of link-fixing grooves 1B for being joined with the link 2.

The link-fixing hook 1A is a hooked member engaged with a front key top-fixing bar 2C of the link 2 to support a rotational movement and a sliding movement of the front key top-fixing bar 2C in accordance with the ascent and descent of the link 2.

The link-fixing groove 1B is a circular groove engaged with a rear key top-fixing bar 2D to support a rotational movement of the rear key top-fixing bar 2D.

In this embodiment, the link-fixing hook 1A is positioned on a front side and the link-fixing groove 1B is positioned on a rear side of the rear surface of the key top 1, but such a positioning may be suitably adjusted according to the positions of the fixing bars of the link 2. Also, it doesn't matter if the hook or the groove is formed in the link 2 and the fixing bar is formed in the key top 1.

The frame 3 is formed with two pairs of projections for joining the frame 3 with the link 2, that is, a pair of corresponding projections 3A for being engaged into second leg holes 2I of a second leg 21 of the link 2 and a pair of corresponding projections 3B for being engaged into first leg holes 2G of a first leg 22 of the link 2. These projections 3A, 3B support sliding movements and circle movements of the second leg holes 2I and the first leg holes 2G, respectively.

These projections 3A, 3B may be formed in the link 2. That is to say, it doesn't matter that the link 2 is formed with the projections and the frame 3 is formed with holes corresponding to the first leg holes and the second leg holes 2I.

Figure 8:
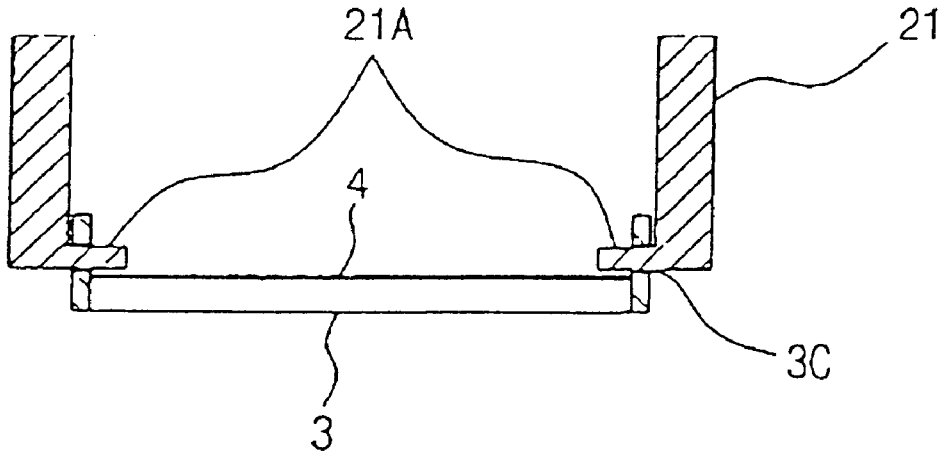
FIG. 8 is a view showing connection of the frame and the link by means of a projection formed in the second leg and a hole formed in the frame.

For example, as shown in FIG. 8, it is possible that the second leg 21 is formed with a pair of second leg projections 21A, the frame 3 is formed with a pair of corresponding upright holes 3C, and the second leg projections 21A are inserted and engaged into the corresponding upright holes 3C. In this case, the FPC 4 is located between the second leg projection 21A and the frame 3, thus preventing the upward floating and free movement of the FPC 4 by the second leg projections 21A. Contacts of the FPC 4, therefore, are always maintained at predetermined positions, and are exactly pushed down by the descent of the link 2, thereby realizing a secure key input.

In order to strengthen the clicking sensation, the link 2 is required to be positioned higher. For this aim, the corresponding upright holes 3C into which the second leg projections 21A are inserted are formed in an upper end portion of the frame 3 to increase overall height of the link 2 and thus to strengthen the clicking sensation.

Figure 12:
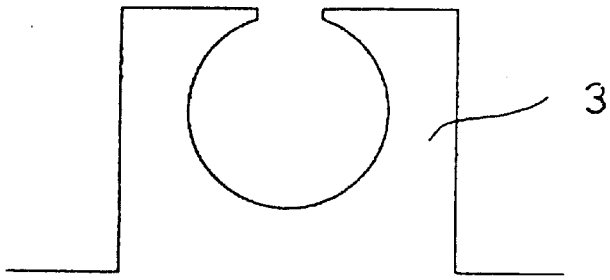
FIG. 12 is a view showing a modified embodiment of a hole for receiving the second leg.

The clicking sensation is further strengthened because a peak load point can be pulled forwardly due to positioning of the upright holes 3C in the upper end portion of the frame 3. This effect of improving the clicking sensation can be maximized if the upright holes 3C are positioned far higher by having a shape opened upwardly as shown in FIG. 12.

Next, a description will be given for the link 2, each constituent member thereof and connections between the respective members of the link 2 and other members of the key switch with reference to FIGS. 1 and 4.

Figure 4A:
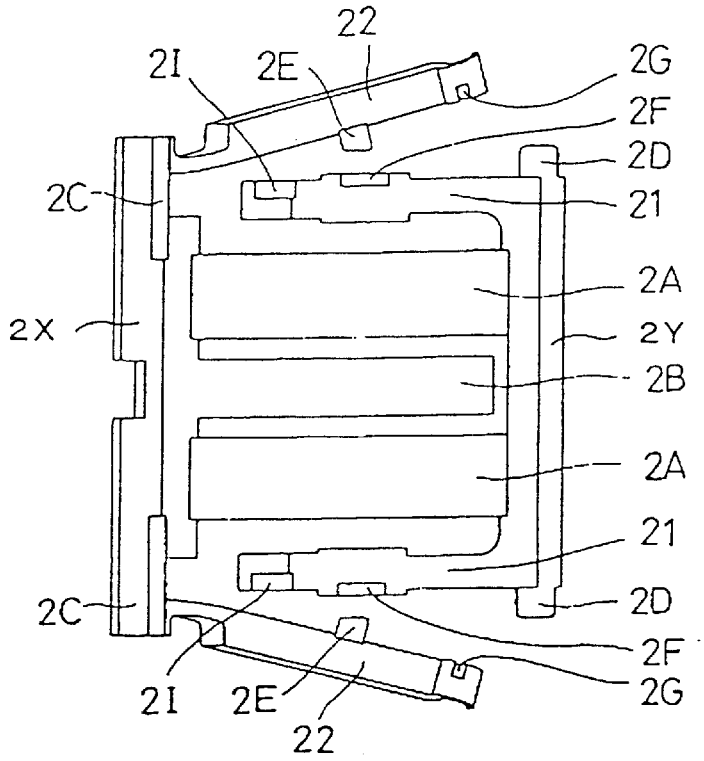
FIGS. 4A, 4B and 4C are respectively a perspective view of a link in accordance with the present invention prior to assembly, a plan view thereof after assembly and a side view thereof after assembly, respectively.
Figure 4B:
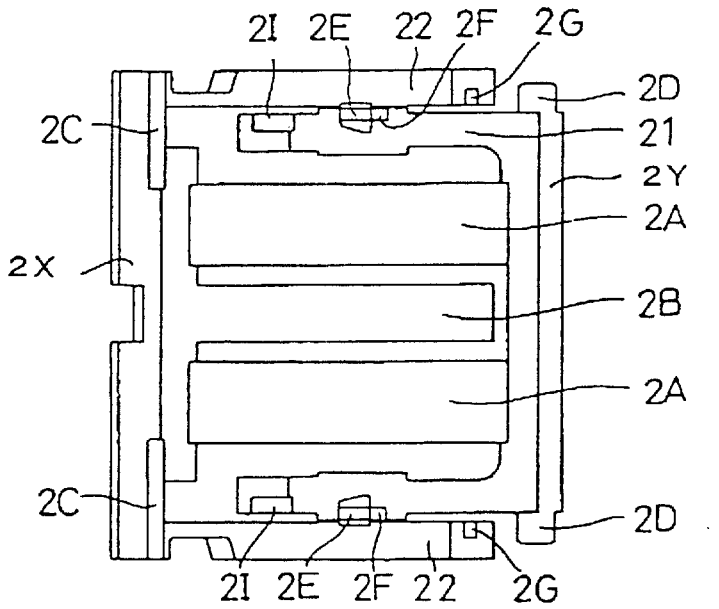
Figure 4C:
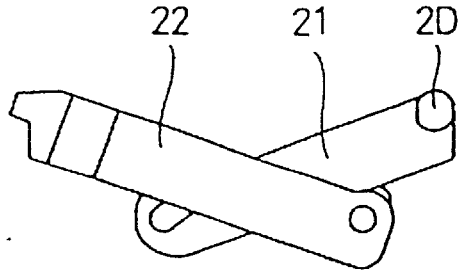

FIG. 4 is a view showing a detailed construction of the link 2, in particular, a perspective view prior to connection with other members (FIG. 4A), a plan view after connection with other members (FIG. 4B) and a side view after connection of other members (FIG. 4C).

The link 2 is a substantially rectangular structure and is integrally molded by injection molding.

Reference numeral "2A" denotes a pair of return plate springs so formed as to be connected with both wings 2X, 2Y of the link 2. The return plate spring 2A has resilient force by taking an arched band shape, so that it serves as a force source to push up and restore the key top to its initial state when the link 2 is subjected to pressure.

Figure 5A:
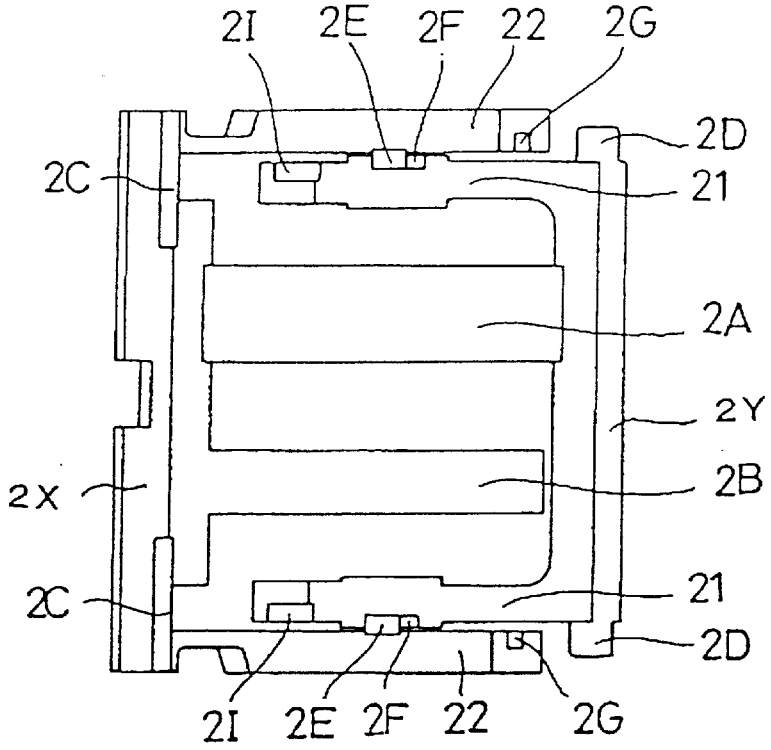
FIGS. 5A and 5B are views showing other embodiments of the present invention, in which one return plate spring is formed (FIG. 5A), or a contact spring is connected with both wings of a frame (FIG. 5B)

In this embodiment, a pair of return plate spring 2A is formed, but only one return plate spring 2A may be formed when the area of the key top is small as shown in FIG. 5A.

Reference numeral "2B" denotes a contact plate spring, which descends and serves to cause a contact surface of the FPC 4, i.e., the matrix switch to be short-circuited when the link 2 is retracted due to the pressure of the key top 1. The contact plate spring 2B takes a circular arched band shape and is formed with a contact projection 2H in a portion corresponding to the contact surface of the FPC 4 in order to apply a positive contacting force to the FPC 4. If the contact plate spring 2B is bent in an arched shape, however, it doesn't matter that no contact projection 2H is formed.

Figure 5B:
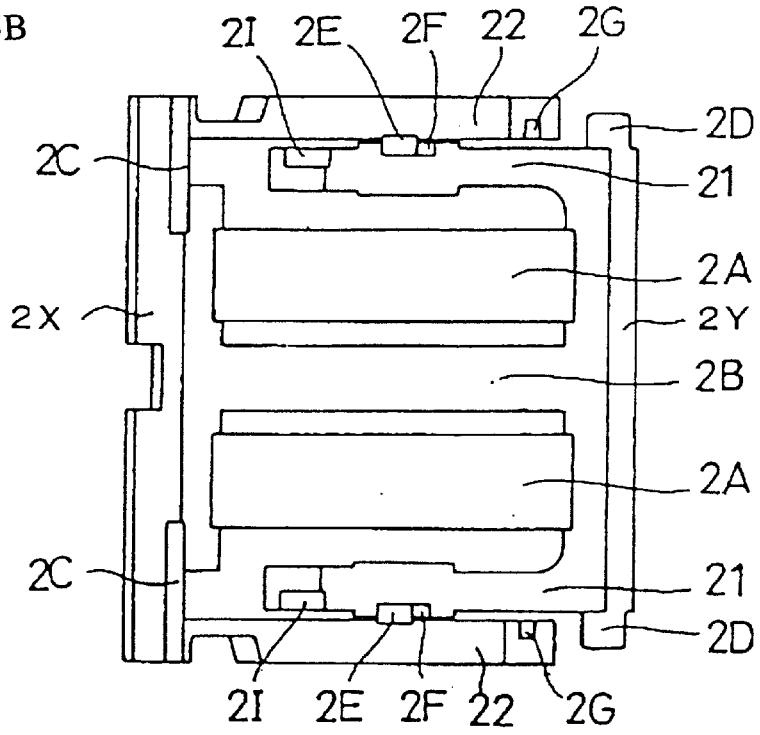

In this embodiment, the contact plate spring 2B is so formed as to be connected with only one wing 2X, but it may be so formed to be connected with both wings 2X, 2Y as shown in FIG. 5B.

Also, in this embodiment, the contact plate spring 2B is formed integrally with other members of the link 2, but it may be manufactured of resilient metal such as steel or the like and then be assembled to or insert-molded into the link 2 in order to enhance its strength.

One wing 2Y of the link 2 is formed with a pair of second legs 21 facing inward. The second leg 21 has a second leg hole 2I as a slot-shaped hole for being connected with the frame 3. The second leg hole 2I is engaged with a corresponding projection 3A of the frame 3 to cause a sliding movement of the corresponding projection 3A for the second leg and to ultimately stop the sliding movement, thereby serving to impart a clicking sensation. That is, the second leg 21 and the frame 3 are pivot-coupled with each other through the slot-shaped hole 2I, which pivot coupling axis is not fixed, but can be moved. Because of this, such a pivot coupling is defined as a free pivot coupling in the present invention.

The second leg 21 is also formed with a leg-pivot coupling hole 2F. This leg-pivot coupling hole 2F is engaged with a leg-pivot coupling projection 2E of a first leg 22 as described below to support a scissoring movement of the second and first legs 21, 22.

On the other hand, the other wing 2X of the link 2 is formed with a pair of first legs 22 facing inward. The first leg 22 is so formed as to possess resilience having a tendency of widening toward right and left sides.

The first leg 22 is formed with a leg-pivot coupling projection 2E for being engaged into the leg-pivot coupling hole 2F of the second leg 21. The leg-pivot coupling projection 2E is not only engaged into and supported to the leg-pivot coupling hole 2F, but is rotationally moved to perform a scissoring movement of the second and first legs 21, 22 in accordance with the descending movement of the key top 1.

Herein, the leg-pivot coupling hole 2F and the leg-pivot coupling projection 2E may exchange their positions. That is, it is possible that the projection 2E is formed in the second leg 21 and the hole 2F is formed in the first leg 22.

The first leg 22 is also formed with a first leg hole 2G for being engaged with a corresponding projection 3B of the frame 3. The first leg hole 2G is engaged with the corresponding projection 3B to cause the first leg 22 to be rotated.

An end of the wing 2X of the link 2 is formed with a front key top-fixing bar 2S for joining the link 2 with a link-fixing hook 1A of the key top 1. The link 2 is joined with the link-fixing hook 1A through a link-fixing groove formed in the front key top-fixing bar 2C. A rear key top-fixing bar 2D is also formed to be joined with a link-fixing groove of the key top 1.

The constituent members of the link 2 are wholly received within a recess formed in the frame 3 when the link 2 goes down. In this way, the overall height of the key switch can be reduced.

Now, assembly of the so constructed key switch will be described.

The first leg 22 of the link 2 injection-molded into a state as shown in FIG. 4A is subjected to an inwardly directed force by hand or pliers so that the leg-pivot coupling projection 2E is engaged into the leg-pivot coupling hole 2F. This engagement state is shown in the plan view of FIG. 4B and the side view of FIG. 4C. It can be seen that the first leg 22 and the second leg 21 are joined with each other in a form of scissors in this engagement state.

The link 2 with the first and second legs 22, 21 joined with each other in the form of scissors is coupled with the frame 3 with the FPC 4 attached thereto as shown in FIG. 1. That is, the second leg hole 2I of the second leg 21 of the link 2 is engaged with the corresponding projection 3A of the frame 3 and the first leg hole 2G of the first leg 22 of the link 2 is engaged with the corresponding projection 3B of the frame 3.

In turn, the link-fixing hook 1A of the key top 1 is locked in the groove of the front key top-fixing bar 2C and the link-fixing groove 1B is engaged with the rear key-top-fixing bar 2D to fix the key top 1 to the link 2.

FIG. 2 shows the key switch thus completed.

The key switch of the above construction operates as described hereinafter.

Figure 6:
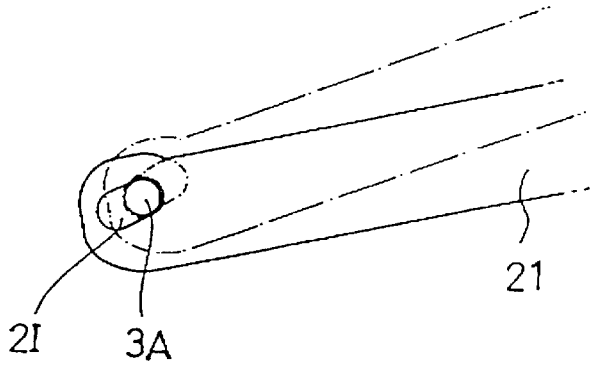
FIG. 6 is a view showing a relative movement between a projection for a second leg and a hole of the second leg in one embodiment of the present invention.

If the key top 1 is pushed down by a user's finger, etc. in the state of FIG. 2, the key top 1 acts against the resilient force of the return plate spring 2A of the link 2. At this time, the first leg 22 of the link 2 is rotated in a counterclockwise direction about the corresponding projection 3B of the frame 3. Thus, the leg-pivot coupling projection 2E of the first leg 22 also comes to descend. On the other hand, the second leg 21 is rotated in a clockwise direction about the leg-pivot coupling projection 2E in the manner of scissors opening. At this time, the leg-pivot coupling projection 2E descends and so the second leg hole 2I is subjected to a force and is pushed in a left-downward direction. Consequently, the corresponding projection 3A of the frame 3 is relatively moved in a right-upward direction along an inclined surface of the slot-shaped second leg hole 2I (moved from a state designated by a dotted line to a state designated by a solid line in FIG. 6).

When the key top 1 descends in this way, the return plate spring 2A performs a widening movement of its arched shape to produce a force having a tendency of raising the key top 1.

If the key top 1 is further pressed, the corresponding projection 3A reaches a right end of the second leg hole 2I (the state designated by the solid line in FIG. 6) to prevent the relative movement of the second leg 21, so that the second leg 21 tends not to descend any more.

Thus, larger load is abruptly applied to the key top 1, additional movement of the second leg 21 is impossible by the corresponding projection 3A if the load exceeds critical load, and the link 2 made of plastic or the like having elasticity begins to be deformed in such a state. If the load is further applied, the return plate spring 2A takes a nearly rectilinear shape from its original circular arched shape. That is, the return spring does not produce a larger force having a tendency of raising the key top 1. As a result, the key top 1 to which a large force has been applied can descend suddenly with small pressure, thereby imparting the clicking sensation to the user.

Simultaneously, the contact plate spring 2B and the contact projection 2H thereof come into press-contact with the PC 4 to achieve the key input.

On the other hand, if the load applied to the key top is released, the return plate spring 2A restores its resilient force to raise and return the key top 1 to its initial state.

The load applied to the key top 1 will be described with reference to FIG. 7.

In the drawing, the transverse axis designates a stoke, i.e., a descending distance of the key top 1, and the longitudinal axis designates pressure load applied to the key top 1. Section "A" of FIG. 7 is a region where the key top 1 begins to descend slowly according to being subjected to pressure in its initial state.

Figure 7:
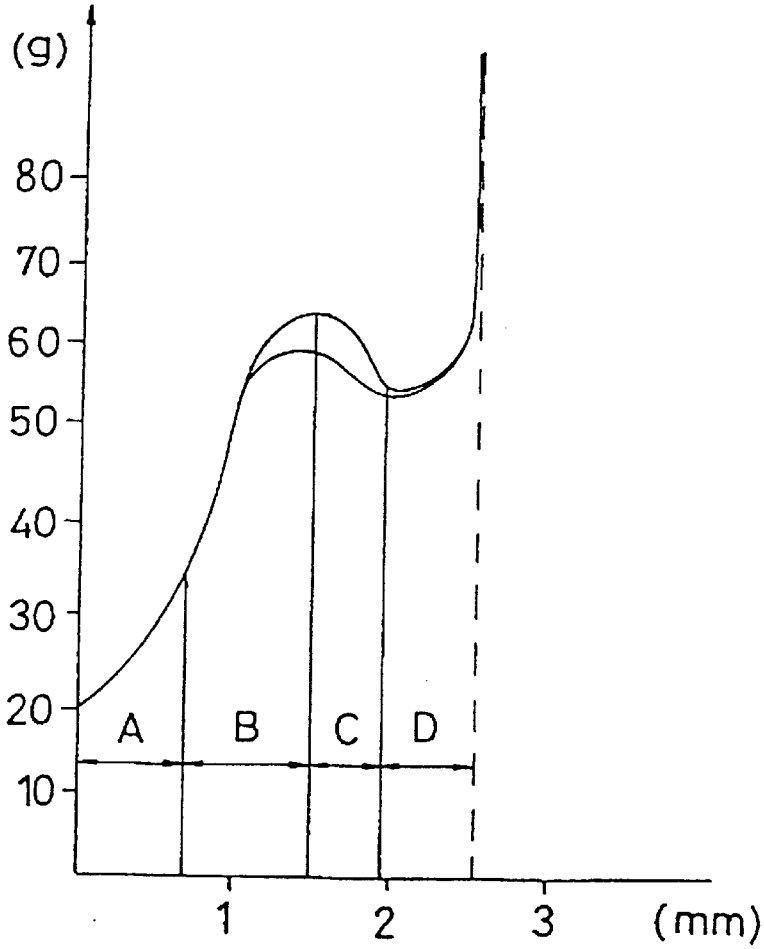
FIG. 7 is a graph showing a relationship between a load applied to a key top and a stroke.

Section "B" of FIG. 7 is a region where the corresponding projection 3A of the frame 3 begins to interrupt the descending movement of the link 2, i.e., the descending movement of the key top 1, so that abrupt larger load is required to continue the descending movement of the key top 1. A point at which a boundary line between the sections "B" and "C" meets the load curve is the point of critical pressure load as described above.

Section "C" of FIG. 7 is a region where the return plate spring 2A takes a nearly rectilinear shape, so that the ascending force of the return plate spring 2A and thus the pressure load of the key top 1 are abruptly reduced, thereby imparting the clicking sensation to the user.

Section "D" is a region where the key top 1 further descends beyond the point of the critical pressure load of the return plate spring 2A, so that the contact plate spring 2B or the contact projection 2H thereof comes into press-contact with the FPC 4 to achieve the key input.

If the load reaches the section "D" and then is released, the return plate spring 2A restores its resilient force to raise the key top 1 with the load forming a hysteresis curve.

EXAMPLE 2

Figure 9:
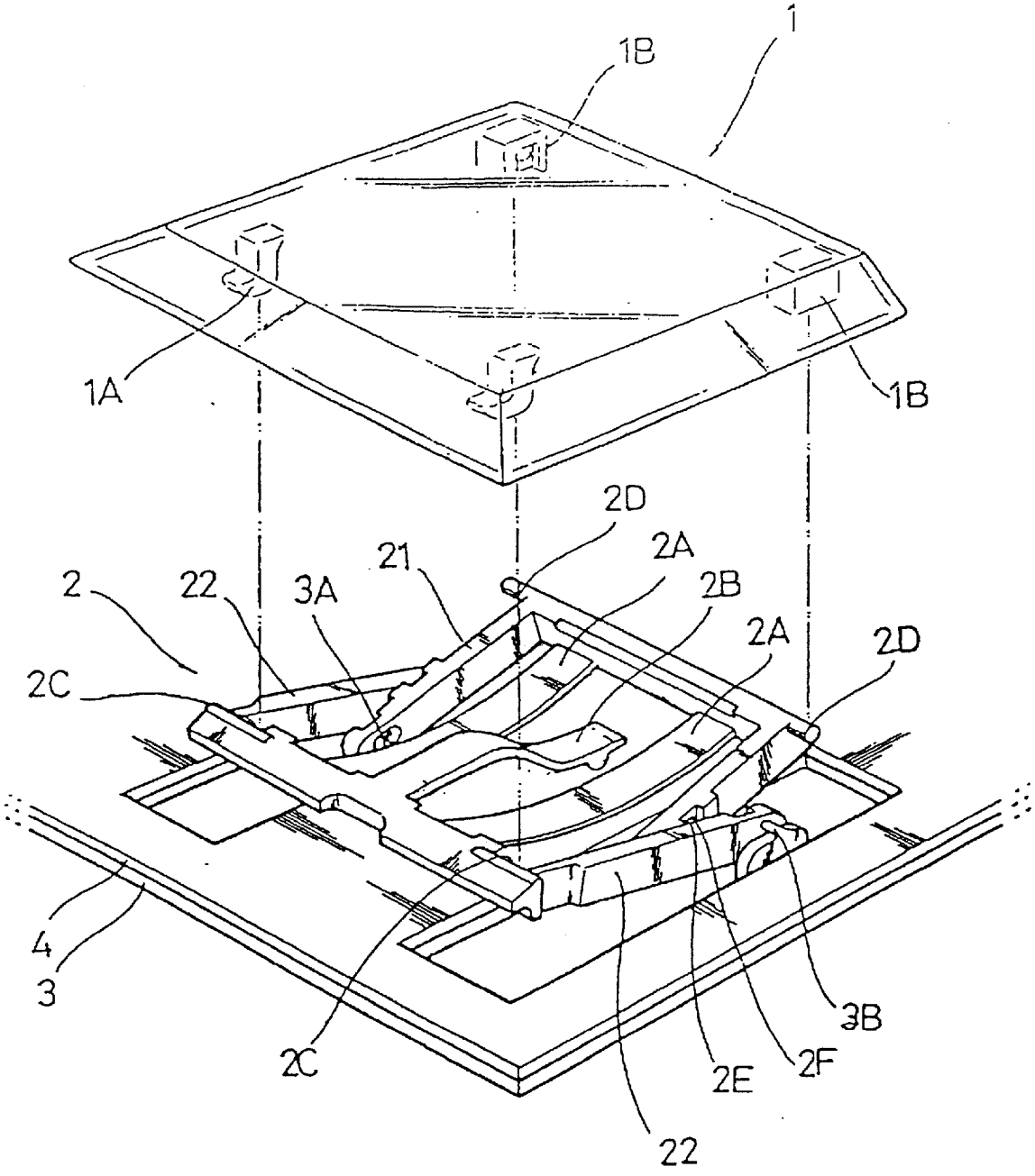
FIG. 9 is a view showing a modified embodiment of the contact plate spring as a second embodiment of the present invention.
Figure 10A:
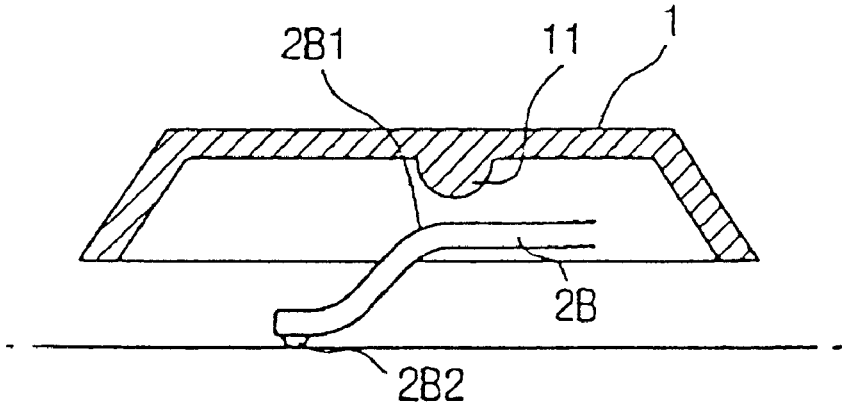
FIGS. 10A, 10B, and 10C are an enlarged view showing only the contact plate spring and the key top in the second embodiment of FIG. 9.
Figure 10B:
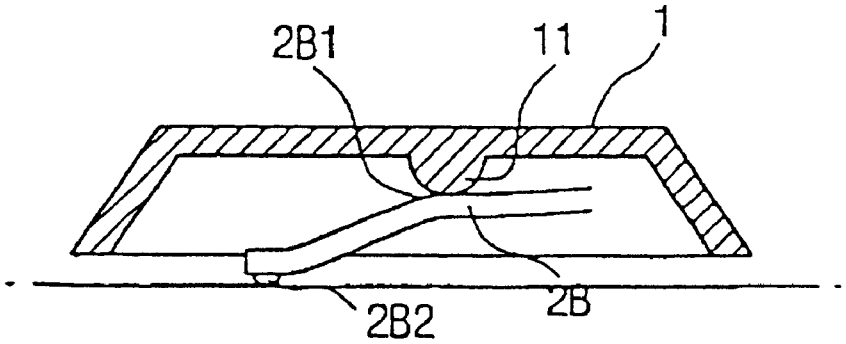
Figure 10C:
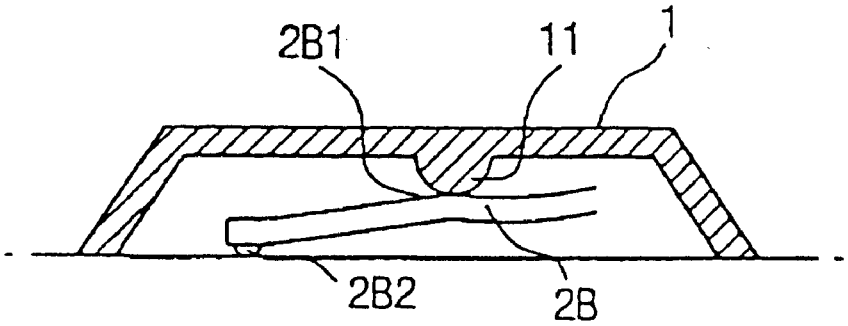

FIG. 9 shows a second embodiment of the present invention. FIG. 10 is an enlarged view showing only the key top 1 and the contact plate spring 2B in the second embodiment. The key switch in accordance with this embodiment differs from the first embodiment in that a key top projection 11 is formed on a lower surface of the key top 1 and the contact spring takes a nearly stair-like shape. Since other constructions of the key switch are the same as those of the first embodiment, a description and a depiction thereof will be omitted.

The second embodiment operates as follows:

The pressure of the key top 1 is transmitted to the link 2 by descent of the key top 1 to press down the contact plate spring 2B. If the key top 1 continues its descending, the key top projection 11 of the key top 1 presses a curved portion 2B1 of the contact plate spring 2B and a projection 2B2 of the contact plate spring 2B begins to come into contact with the contact of the FPC 4 (see FIG. 10B) . If the key top 1 further descends, the return plate spring 2A is bent, so that the key top 1 abruptly descends. At this time, the key top projection 11 of the key top 1 comes into contact with the curved portion 2B1 of the contact plate spring 2B to transmit the descending pressure to the contact plate spring 2B. Since the contact plate spring 2B takes a nearly stair-like shape, it absorbs the pressure of the key top 1 while changing its shape. Thus, the key top 1 relatively smoothly descends and comes into contact with the frame 3, thereby removing a noise caused by abrupt descent of the key top 1 and collision of the key top with the frame 3.

Also, since the key top projection 11 reinforces the key top 1, there is an effect that the key switch having high durability is provided.

EXAMPLE 3

Figure 11:
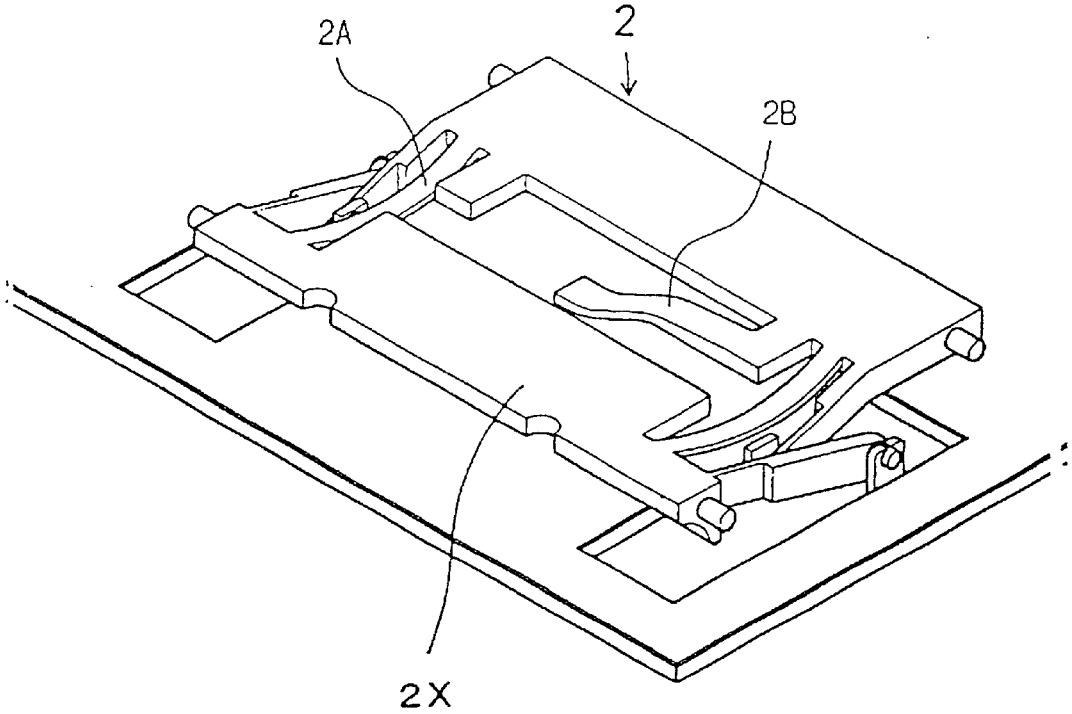
FIG. 11 is a view showing the contact plate spring formed parallel to the wings in a third embodiment of the present invention.

FIG. 11 shows only the link part 2 of the key switch in accordance with another embodiment of the present invention. Since other constructions of the key switch are the same as those of the first embodiment, a description and a depiction thereof will be omitted.

The key switch of this embodiment is used as a multiple key having a large traverse length for use in a special key such as a "space" key or a "enter" key.

The link 2 used for this key switch includes the wing 2X having large area. This is provided for the purpose of transmitting the pressure of the key top 1 uniformly and reliably to the whole link 2. That is, it serves as a substitute for the existing link bar.

Also, the contact plate spring 2B is provided parallel to the wing 2X. While the length of the contact spring 2B must be more than a certain value in order to secure a resilient force of the contact spring, the length of the contact spring 2B is obliged to be short in order to make the wing thick. Thus, the contact spring 2B is formed in such a manner that it is rotated by 90° with respect to the position of the first and second embodiments.

Consequently, not only the wing of the link 2 becomes thick enough to reinforce the link 2, but also the resilient force of the contact spring 2B can be maintained adequately.

As described above, the present invention make it possible to produce the key switch at a low cost because the link is integrally formed by injection molding. Also, the first leg is easily and simply assembled to the frame only by pressing the first leg inwardly.

The clicking sensation can be simply obtained in such a manner that the slot-shaped hole formed in the second leg is engaged with the projection of the frame, the projection interrupts the sliding movement of the hole, and the return plate spring takes a nearly rectilinear shape to abruptly reduce load applied to the key top when the load exceeds the critical pressure load. That is, the clicking sensation can be generated by a simple structure in which the slot-shaped hole and the corresponding projection are formed in the return plate spring or the frame.

Also, the contact of the FPC is exactly pressed on descent of the key top because the FPC is prevented from moving by inserting the second leg projection formed in the second leg into the corresponding hole formed in the frame and locating the FPC between the projection and the frame. The clicking sensation is further strengthened because a peak load point can be pulled forwardly due to positioning of the hole in an upper end portion of the frame. Furthermore, the clicking sensation can be maximized if the hole is opened upwardly and so is positioned higher.

A noise caused by collision of the key top with the frame can be reduced because the pressure of the key top is absorbed by the return plate after the return plate spring takes the nearly rectilinear shape by forming the key top projection on the lower surface of the key top and forming the return plate spring in the nearly stair-like shape. Owing to this, the contact of the FPC can be reliably pressed.

The key switch can be used as the multiple key because the return spring is sufficiently long and simultaneously the wing is adequately thick by forming the return plate spring parallel to the wing of the link.

Although preferred embodiments of the present invention has been described for illustrative purposes, those skilled in the art will appreciate that various modifications, additions and substitutions are possible, without departing from the scope and spirit of the invention as disclosed in the accompanying claims.

What is claimed is:

1. A key switch comprising:

a key top for receiving pressure from a user's finger;

a link, coupled to the key top, for lowering the key top when pressure is applied to the key top and for pushing the key top upwardly when the pressure is released; and a flexible printed circuit provided on an upper surface of a keyboard frame for recognizing key action by a pressing-contact of the link therewith;

wherein the link comprises integrally formed first and second legs being pivot-coupled with each other, an integrally formed return plate spring applying a returning force to the key top, and an integrally formed contact plate spring coming into pressing-contact with the flexible printed circuit, the first leg being also pivot-coupled with the frame and the second leg being also freely pivot-coupled with the frame through a slot-shaped hole, so that the second leg and the frame are slid relative to each other along the slot-shaped hole and stop the relative sliding movement at an end of the slot-shaped hole when the key top is pushed down against a resilient force of the return plate spring.

2. A key switch according to claim 1, wherein a contact projection is formed on a lower surface of the contact plate spring.

3. A key switch according to claim 1, wherein two return plate springs are formed with the contact plate spring interposed therebetween.

4. A key switch according to claim 1, wherein the return plate spring is one in number and the contact plate spring is one in number.

5. A key switch according to claim 1, wherein, if the pressure on the key top is further increased after the relative sliding movement stops, the return plate spring takes a nearly rectilinear shape to abruptly reduce the pressure, thereby imparting a clicking sensation.

6. A key switch according to claim 1, wherein the return plate spring is separately formed and then is assembled to or insert-molded into the link.

7. A key switch according to claim 6, wherein the return plate spring is formed of resilient metallic material.

8. A key switch according to claim 1, 5 or 6, wherein the link is formed by a mold.

9. A key switch according to claim 1, wherein the first leg has resilience and a tendency of widening toward right and left sides.

10. A key switch according to claim 1, wherein a pair of upright holes are formed in the frame, projections formed at both ends of the second leg are inserted into the upright holes, and the flexible printed circuit is located between the projections and the frame.

11. A key switch according to claim 10, wherein at least one of the upright holes is located in an upper end portion of the frame and is opened upwardly.

12. A key switch according to claim 1, wherein a projection is formed on a lower surface of the key top the contact plate spring is formed in a nearly stair-like shape so that the pressure of the key top is absorbed by the contact plate spring.

13. A key switch according to claim 1, wherein the contact plate spring is provided parallel to wings of the link to form wing portions of the link with large thickness.

14. A key switch according to claim 1, wherein the link is wholly received within a recess of the frame.

* * * * *